US006145580A

United States Patent [19]

Lamberti et al.

[11] Patent Number: 6,145,580

[45] Date of Patent: Nov. 14, 2000

[54] CONTINUOUS-CASTING MOLD WITH SMALL SIDE ADJUSTMENT

[75] Inventors: Thomas Lamberti; Joachim Schwellenbach, both of Düsseldorf, Germany

[73] Assignee: SMS Schloemann-Siemag AG, Dusseldorf, Germany

[21] Appl. No.: 09/205,501

[22] Filed: Dec. 4, 1998

[30] Foreign Application Priority Data

Dec. 5, 1997 [DE] Germany ..... 197 53 959

[51] Int. Cl.[7] ..... B22D 11/041; B22D 11/05

[52] U.S. Cl. ..... 164/418; 164/436

[58] Field of Search ..... 164/418, 436, 164/491

[56] References Cited

U.S. PATENT DOCUMENTS

| | | | |
|---|---|---|---|
| 3,913,658 | 10/1975 | Schmid | 164/436 |
| 4,523,623 | 6/1985 | Holleis et al. | 164/436 |

FOREIGN PATENT DOCUMENTS

| | | | |
|---|---|---|---|
| 0 241 825 | 1/1987 | European Pat. Off. . | |
| 0 276 418 | 8/1988 | European Pat. Off. . | |
| 0 417 504 | 3/1991 | European Pat. Off. . | |
| 2645460 | 10/1990 | France | 164/491 |
| 3833014 | 10/1990 | Germany | 164/491 |
| 40 23 672 | 2/1992 | Germany . | |

*Primary Examiner*—Kuang Y. Lin
*Attorney, Agent, or Firm*—Herbert Dubno

[57] ABSTRACT

A continuous-casting mold having two broad-side walls carrying the mold-forming plates which are preferably of copper and clamp the narrow side wall members between them. The entire assembly is received in an outer frame which is shape stable and hence rigid so as to take up all forces which arise in adjustment of the plates as clamping forces and as thermal forces from, for example, thermal expansion of the mold members.

5 Claims, 1 Drawing Sheet

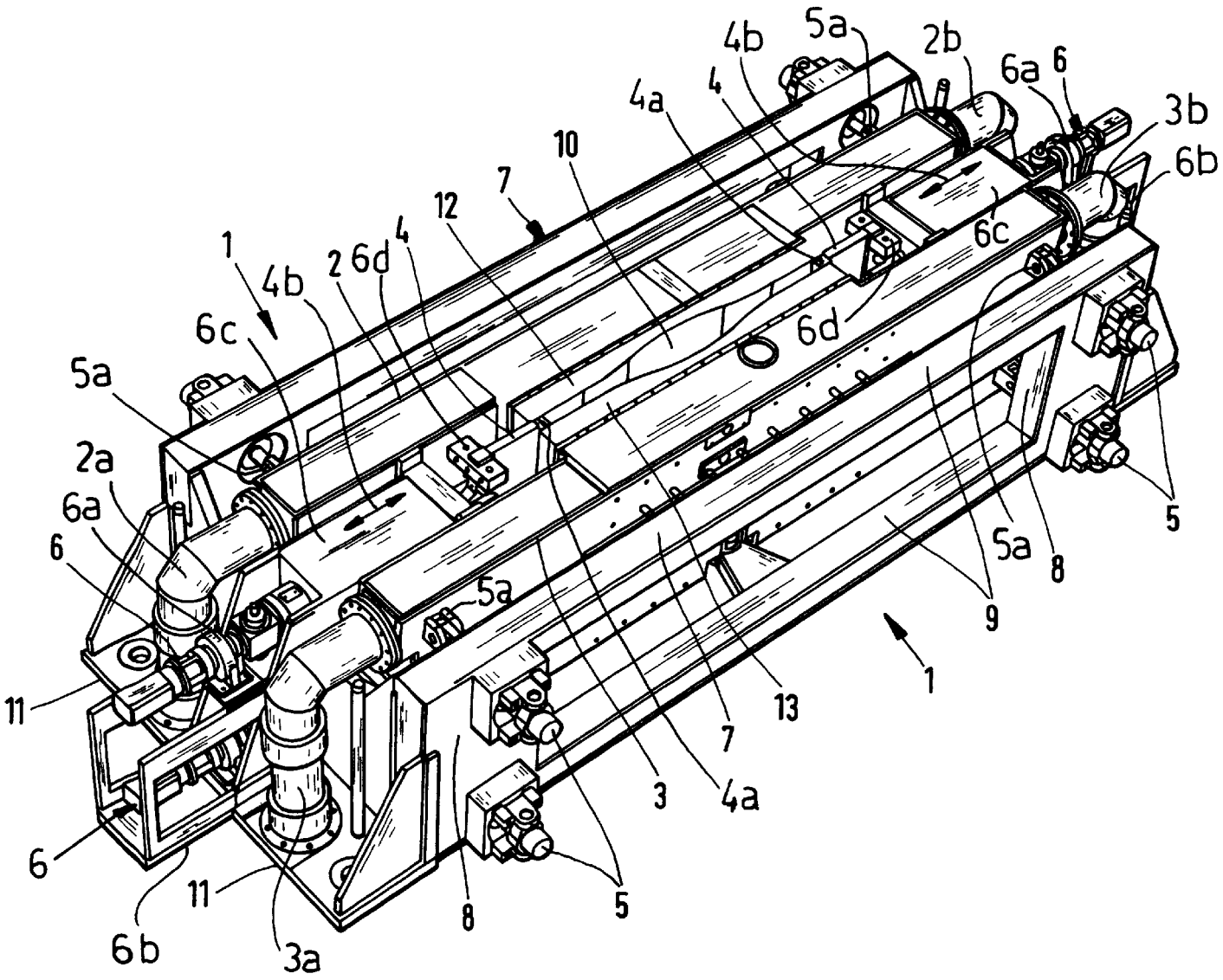
3b
6b
6
6a
2b
5a
4b
4
4a
6c
6d
5
8
5a
9
1
13
7
4a
3
10
7
12
4
2
6d
4b
1
6c
5a
2a
6a
6
11
5
8
5a
3a
11
6b
6

CONTINUOUS-CASTING MOLD WITH SMALL SIDE ADJUSTMENT

FIELD OF THE INVENTION

Our present invention relates to a continuous-casting mold of the type which has two mutually juxtaposed broad sides and a pair of narrow sides flanking the melt and adjustable between the broad sides to determine the width of the strand emerging from the continuous casting mold. More particularly, the invention relates to a mold in which the broad side walls, usually fabricated from copper and which can be cooled, e.g. by a flowable coolant, are received in a support frame in or on which mthe narrow side walls are adjustable. The narrow/side walls can be clamped between the broad side walls by a force-generating means braced between the frame and the broad side walls to adjust the clamping force and the degree to which the broad side walls can be moved or pressed toward one another against the member forming the narrow side walls.

BACKGROUND OF THE INVENTION

A continuous casting mold of the aforementioned described type is disclosed in EP 0 417 504 B1. In this construction, the broad side walls form a unit with the support frame in which the support frame is connected with the broad side walls by elements generating a displacement of the broad side walls relative to one another, whereby the broad side walls can move toward and away from one another. Such a mold has been referred to also as a "spreadable" mold.

The elements generating the relative movement of the broad side walls can be tie rods or tension rods, i.e. mechanical stressing elements, which connect both of the support frames with their respective broad side walls. For this purpose the resiliently elastic tension rods can be operatively connected with a force-generating means.

OBJECTS OF THE INVENTION

It is the principal object of the present invention to provide a continuous-casting mold assembly which is an improvement over the prior art device with respect to the displacement and clamping action of the broad side walls, enabling the clamping action and the release for width adjustment of the small-side walls which avoids the transmission of forces in an undesirable manner, e.g. to the lifting mechanism on which the mold assembly is carried.

Another object of the invention is to provide an improved mold assembly for the purposes described which contains the mold in a closed-force system.

It is another object of the invention to provide a mold assembly for continuous casting which avoids drawbacks of earlier mold assemblies.

SUMMARY OF THE INVENTION

These objects are attained in accordance with the invention by providing a shape-stable outer frame which receives the broad side walls of the mold and the small side walls between them and which connects the two sides of the mold in a closed-force system so that the broad side walls of the mold and the small side walls between them are received within the outer frame and are centered relative to the center of the outer frame.

The broad side walls can be formed with copper plates mounted on the movable wall members and since the broad side walls are braced against respective rectangular frame parts of the outer frame by fluid-actuated elements, force transmission of forces generated in the mold and in clamping the broad side walls against the members forming the narrow side walls to the lifting is mechanism carrying the mold can be prevented entirely.

Because on all sides of the mold an outer frame surrounds the mold members, all forces which arise within the mold are taken up or balanced in the closed-force system formed by the rigid or shape-stable outer frame. This applies to forces resulting from thermal expansion especially of the broad side walls or forces which may arise by adjustment of the small side walls.

According to a feature of the invention, on each broad side of the outer frame, preferably four hydraulic cylinders are fastened and are braced against the respective broad side wall to move the broad side walls toward and away from one another.

The outer frame members juxtaposed with the broad side walls comprise longitudinal bars, arms or limbs connected by transverse bars or limbs and holding the longitudinal limbs in a mutually parallel relationship so that each outer frame member juxtaposed with the broad side walls is a rectangular frame. The hydraulic cylinders are preferably mounted on the transverse elements.

Bridge elements may interconnect the rectangular frame elements at opposite ends thereof. The devices for displacing the narrow side walls can be mounted on the bridge elements and preferably are disposed in a line with the narrow-side walls, most advantageously in a longitudinal median plane of the assembly.

More particularly, the continuous-casting mold assembly of the invention can comprise:

- a pair of mutually juxtaposed spaced-apart coolable broad side walls carrying respective broad-side mold plates;
- respective members on opposite ends of the assembly defining narrow side walls received between the mold plates and clampable therebetween, the members being movable toward and away from one another for adjustment of a width of a cast strand;
- a shape-stable outer frame receiving the broad side walls with the broad-side mold plates thereon and the members;
- force-generating means between the outer frame and the broad side walls for displacing the broad side walls toward and away from one another and for clamping the plates against the members; and
- means on the outer frame for shifting the members toward and away from one another, the outer frame receiving reaction forces of the force-generating means and the means for shifting in a closed force system.

BRIEF DESCRIPTION OF THE DRAWING

The above and other objects, features, and advantages will become more readily apparent from the following description, reference being made to the accompanying drawing, the sole FIGURE of which is a perspective view from above of a spreadable continuous-casting mold according to the invention.

SPECIFIC DESCRIPTION

The continuous-casting mold shown in the drawing and mounted as the assembly illustrated upon the lifting mechanism which is conventionally provided in the continuous-casting line, can include the mold proper, represented at 10 and formed between the inwardly facing sides of the mold plates 12 and 13 which are usually formed of copper or are predominantly formed of copper and the end faces 4*a* forming the narrow side walls, of a pair of members 4 which can extend between the plates 12 and 13 and can be clamped between them. The adjustment of the members 4 in the direction of the arrows 4*b* permits adjustment of the width of the continuous strand emerging from the bottom of the assembly when the melt is poured into the mold 10 at the top of the assembly.

Two adjustment mechanisms 6 at each end of the mold can be provided to shift the members 4 and define the strand width. The mechanism 6 may be screw mechanisms, hydraulic cylinders or the like. These mechanisms are carried by supports 6*a* on a pair of bridge pieces 11 at the ends of the mold via frames 6*b*. Hence the reaction force is applied from the frame 6*b* to the bridge piece 11. The mechanisms 6*a* extend through the guide blocks 6*c* received between the broad side walls 2 and 3 carrying the copper plates 12 and 13 to shift the clamps 6*d* in which the copper members 4 are removably mounted.

The broad side walls 2 and 3 are cooled in a conventional manner and for this purpose coolant lines 2*a*, 2*b* and 3*a*, 3*b* can be provided. The plates 2 and 3 are movable toward and away from one another and can, upon movement toward and away from one another, clamp the members 4 between the copper plates 12 and 13 carried by the broad side walls 2 and 3.

According to the invention, the spreadable mold 10 with its copper plates 12 and 13 carried by the broad side wall is received within a shape-stable outer frame capable of taking up the reaction forces of the mold walls 2, 3 and 4 thereon and the forces generated in clamping, in a closed-force system.

The force-generating means for urging the broad side walls 2, 3 symmetrically toward one another and toward the center line of the assembly (and for spreading the members 2 and 3 apart) is constituted by four hydraulic cylinders 5 braced between each broad side wall 2, 3 and a rigid frame 7 juxtaposed with the broad side walls 2 or 3 along the respective broad side of the assembly.

Each of the rigid rectangular frames 7 is formed from a pair of longitudinal bars 9 connected at their ends by transverse bars 8, the bars all being of rectangular cross section. The hydraulic cylinders 5 are mounted on the transverse bars 8. The hydraulic cylinders have piston rods which are articulated at 5*a* to the respective broad side walls 2, 3.

The broad side rigid frame 7 is connected by the bridge element 11 previously mentioned to form the shape-stable outer frame.

Since the outer frame 1 encompasses the mold 10 on all sides, all reaction forces which are generated whether they are thermally created forces (forces produced by thermal expansion) or adjustment forces are taken up by the closed-force system of the outer frame. No residual reaction force is transmitted outwardly. The outer frame 1 is so configured that the broad side walls 2, 3 which carry the copper plates 12 and 13 are always centered with respect to the center of the assembly and upon thermal expansion of the broad side walls 2, 3 and the copper plates 12, 13, these elements all expand symmetrically so that the forces which must be transmitted to the outer frames from the broad side walls 2, 3 and the small side walls 4 of the mold are reduced to a minimum.

By providing the adjustment mechanisms for the small side walls on the bridge elements and in line with one another, again the forces in opposite directions on the rigid frame are balanced and play in the system is minimized.

The outer frame and especially the rectangular frame configuration at the broad side 7 enable electromagnetic coils to be mounted on the frame so that the assembly can be used as an electromagnetic brake for the flow of the molten metal through the mold or an electromagnetic stirrer or agitator for the melt. The electromagnetic brake or the electromagnetic stirrer can be inserted from the exterior through the frame between the broad side walls 2, 3 if desired.

We claim:

1. A continuous-casting mold assembly comprising:

a pair of mutually juxtaposed spaced-apart coolable broad side walls carrying respective broad-side mold plates;

respective members on opposite ends of said assembly defining narrow side walls received between said mold plates and clampable therebetween, said members being movable toward and away from one another for adjustment of a width of a cast strand;

a shape-stable outer frame receiving said broad side walls with said broad side mold plates thereon and said members;

force-generating means between said outer frame and said broad side walls for displacing said broad side walls toward and away from one another and for clamping said plates against said members; and means on said outer frame for shifting said members toward and away from one another, said outer frame receiving reaction forces of said force-generating means and said means for shifting in a closed force system, said force-generating means including a plurality of hydraulic cylinders braced against said outer frame and acting upon each of said broad side walls, said outer frame comprising respective rigid rectangular frame elements juxtaposed with outer sides of said broad side walls and each composed of a pair of longitudinal bars interconnected by transverse bars, said hydraulic cylinders being mounted on said transverse bars.

2. The mold assembly defined in claim 1 wherein said force-generating means includes four of said hydraulic cylinders braced against said outer frame and acting upon each of said broad side walls.

3. The mold assembly defined in claim 2 wherein said frame further comprises respective bridge elements at the opposite ends of the assembly interconnecting said rigid rectangular frame elements.

4. The mold assembly defined in claim 3 wherein said means for shifting includes respective actuators mounted on each of said bridge elements, said actuators and said members defining said narrow side walls lying in line with one another.

5. The mold assembly defined in claim 4 wherein said broad side walls carrying said plates are displaced within said frame so as to be centered relative thereto.

* * * * *